United States Patent [19]

Thomson

[11] Patent Number: 4,768,314

[45] Date of Patent: Sep. 6, 1988

[54] APPARATUS FOR GENERATING AN ABRASIVE FLUID JET

[75] Inventor: Archibald Thomson, Cranfield, England

[73] Assignee: Fluid Engineering Products Limited, Milton Keynes, England

[21] Appl. No.: 915,069

[22] PCT Filed: Jan. 14, 1986

[86] PCT No.: PCT/GB86/00025

§ 371 Date: Sep. 15, 1986

§ 102(e) Date: Sep. 15, 1986

[87] PCT Pub. No.: WO86/04290

PCT Pub. Date: Jul. 31, 1986

[30] Foreign Application Priority Data

Jan. 16, 1985 [GB] United Kingdom ..... 8501091

[51] Int. Cl.[4] ..... B24C 7/00

[52] U.S. Cl. ..... 51/436; 51/439

[58] Field of Search ..... 51/319, 320, 321, 410, 51/427, 436, 437, 439

[56] References Cited

U.S. PATENT DOCUMENTS

| | | | |
|---|---|---|---|
| 2,440,643 | 4/1948 | Pettinos | 51/11 |
| 3,055,149 | 9/1962 | Luce | 51/11 |
| 3,343,304 | 9/1967 | Eppler | 51/436 |
| 3,553,895 | 1/1971 | Power | 51/439 X |
| 4,044,507 | 8/1977 | Cox et al. | 51/427 X |
| 4,319,435 | 3/1982 | Suzuki et al. | 51/436 X |
| 4,330,968 | 5/1982 | Kobayashi et al. | 51/425 |
| 4,642,944 | 2/1987 | Fairhurst et al. | 51/436 |

FOREIGN PATENT DOCUMENTS

| | | |
|---|---|---|
| 735384 | 11/1932 | France . |
| 915258 | 10/1946 | France . |
| 1060192 | 3/1954 | France . |
| 1080033 | 12/1954 | France . |
| WO 83/03557 | 10/1983 | PCT Int'l Appl. . |

OTHER PUBLICATIONS

Patent Abstract of Japan, vol. 8, No. 136 (M-304) (1573), Jun. 23, 1984. No. 59-37054.

Patent Abstract of Japan, vol. 7, No. 165 (M-230) (1310), Jul. 20, 1983, No. 58-71064.

Patent Abstract of Japan, vol. 8, No. 152 (M-309) (1589), Jul. 14, 1984, No. 59-47164.

*Primary Examiner*—Robert P. Olszewski

*Attorney, Agent, or Firm*—Shapiro and Shapiro

[57] ABSTRACT

Apparatus for generating an abrasive fluid jet comprises a feeding device (2) for continuously passing abrasive particles at a constant rate to a mixing hopper (4) in which the abrasive particles are mixed with a carrier liquid to produce a slurry of consistent concentration. A pump (10) pumps the slurry from the mixing hopper (4) to a jetting head (12) into which a high speed fluid jet is introduced in a direction substantially axially, whereby the abrasive particles are entrained in the fluid jet and ejected from the head (12) at high speed to impinge upon an object to be abrasively treated.

7 Claims, 2 Drawing Sheets

APPARATUS FOR GENERATING AN ABRASIVE FLUID JET

BACKGROUND OF THE INVENTION

This invention relates to apparatus for generating an abrasive fluid jet and especially to such apparatus for use in cleaning and cutting operations.

Prior apparatus of this sort includes a jetting head for ejecting a jet of abrasive particles entrained in a stream of a fluid which may be either gas or liquid, normally either air or water. The fluid is normally passed axially through the head as a high pressure jet and the abrasive particles are introduced into the fluid jet generally at an angle to the direction of flow thereof and are entrained in the jet so that a jet of abrasive particles is ejected at high speed from the outlet of the head onto the article to be abrasively treated. The abrasive particles are introduced into the head in flowable form and may be either dry, in which case they are usually fed into the jet already entrained in air, or wet, in which case they are normally fed into the jet in the form of a liquid slurry. In most hitherto known apparatus the head operates as a jet pump in that the venturi effect of the fluid jet passing through the head draws the abrasive particles into the head.

The hitherto known apparatus has a number of disadvantages which primarily arise because the head operates as a jet pump. First, the concentration of abrasive particles that can be entrained in the fluid jet is limited by the pumping capacity that can be generated thereby and moreover it is extremely difficult to ensure a constant concentration of abrasive particles in the jet. Secondly, the source of abrasive particles must be close to the head because the jet pump cannot draw the abrasive particles through long runs of piping. Thirdly, when the fluid jet is reduced or switched off the pump action drops to such levels that the abrasive particles settle in the feed pipe thus causing blockage of the feed pipe. Such blockages are virtually impossible to clear simply by re-generating the fluid jet to recreate the jet pump effect.

Because of the low concentration of abrasive material and the inconsistencies in the concentration it has not proved possible with the hitherto known apparatus to provide an abrasive jet with the capacity for cutting hard materials such as stone and metals and the use of the hitherto known apparatus has generally been limited to cleaning operations and the cutting of soft materials.

SUMMARY OF THE INVENTION

This invention provides apparatus which does not suffer from the above disadvantages and which allows the generation of an extremely high speed jet carrying a very high and consistent concentration of abrasive particles that can be used for cutting such materials such as reinforced concrete and metals such as stainless steel pipe and sheet and which can also be operated at lower pressures and/or lower concentrations of abrasive particles to allow delicate cleaning operations such as descaling of castings and the like.

According to the invention apparatus for generating an abrasive fluid jet comprises feed means for continuously passing a measured amount of abrasive particles to a mixing hopper in which the abrasive particles are mixed with a carrier liquid to produce a slurry of consistent concentration, pump means for pumping the slurry from the mixing hopper to a jetting head, means for introducing a stream of fluid into the jetting head as a high speed jet in a direction substantially axially of the jetting head whereby the abrasive particles are entrained in the fluid jet and ejected from the head at high speed to impinge upon an object to be abrasively treated.

The jetting head is preferably of the type described and shown in our copending Application EP-A-019203 and comprises a housing defining a transfer space; outlet means defining an outlet aperture extending from the transfer space; jetting nozzle means of smaller cross section than the outlet means for directing a fluid as a jet axially into the transfer space and through the outlet aperture; inlet means located downstream from the jetting nozzle means along the axis of the jetting head for directing the slurry of abrasive particles tangentially into the transfer space; the interior walls of the housing and the position of the inlet means being such that the slurry is conducted through the transfer space towards the jet such that the slurry moves spirally upstream of the inlet means whereby the centrifugal action separates the abrasive particles from the carrier liquid, the abrasive particles moving preferentially to the periphery of the transfer space and being constrained by the wall of the housing at the upstream end of the transfer space to move towards the axis of the jetting head to be entrained in the carrier fluid jet issuing from the jetting nozzle and to pass through the outlet means while the carrier liquid from the slurry passes through the outlet means as an annular layer surrounding the fluid jet with its entrained abrasive particles.

With this arrangement the particles are entrained substantially in the outer surface of the fluid jet and on passage through the outlet means are substantially separated from contact with the material defining the outlet means by the layer of carrier liquid, thereby reducing abrasion of the outlet means.

Preferably the feed means for the abrasive particles comprises an upwardly extending worm operating within a tube and having a significant radial clearance within the tube. This clearance between the worm and the tube allows excess abrasive particles to slip back freely towards the abrasive particles supply thereby substantially eliminating abrasive wear on the walls of the tube. Thus, although there is abrasive wear on the screw it is much cheaper and simpler only to have to replace the screw rather than the whole of the feed means. The amount of abrasive particles fed to the mixing hopper can be adjusted by adjusting the rate of rotation of the screw or by replacing the screw with one of different carrying capacity.

The mixing hopper is preferably a hopper of frustoconical section and the carrier liquid is preferably fed into the bottom of the hopper with a swirling motion such as to thoroughly wet the abrasive particles and to maintain them in a suspension of constant concentration. The liquid feed to the mixing hopper may, for example, comprise a pipe having a plurality of radially-extending outlets at one end extending down one wall of the hopper to a point at or towards the bottom thereof so that the liquid issuing from the radial outlets causes a swirling motion in the bottom of the hopper which extends to the upper regions of the hopper and thus keeps the whole contents of the hopper in motion. With this arrangement there is no need to have a stirrer in the hopper and this a positive advantage since any stirrer would be subject to abrasion by the abrasive particles and would have to be frequently replaced.

The slurry of abrasive particles and carrier liquid leaves the hopper from the bottom thereof and is fed to a pumping means, which may be a positive displacement pump, or preferably a centrifugal pump, and pumped to the jetting head.

BRIEF DESCRIPTION OF THE DRAWINGS

The invention will now be described in greater detail by way of example with reference to the drawings in which.

DETAILED DESCRIPTION OF THE INVENTION

Figure 1:
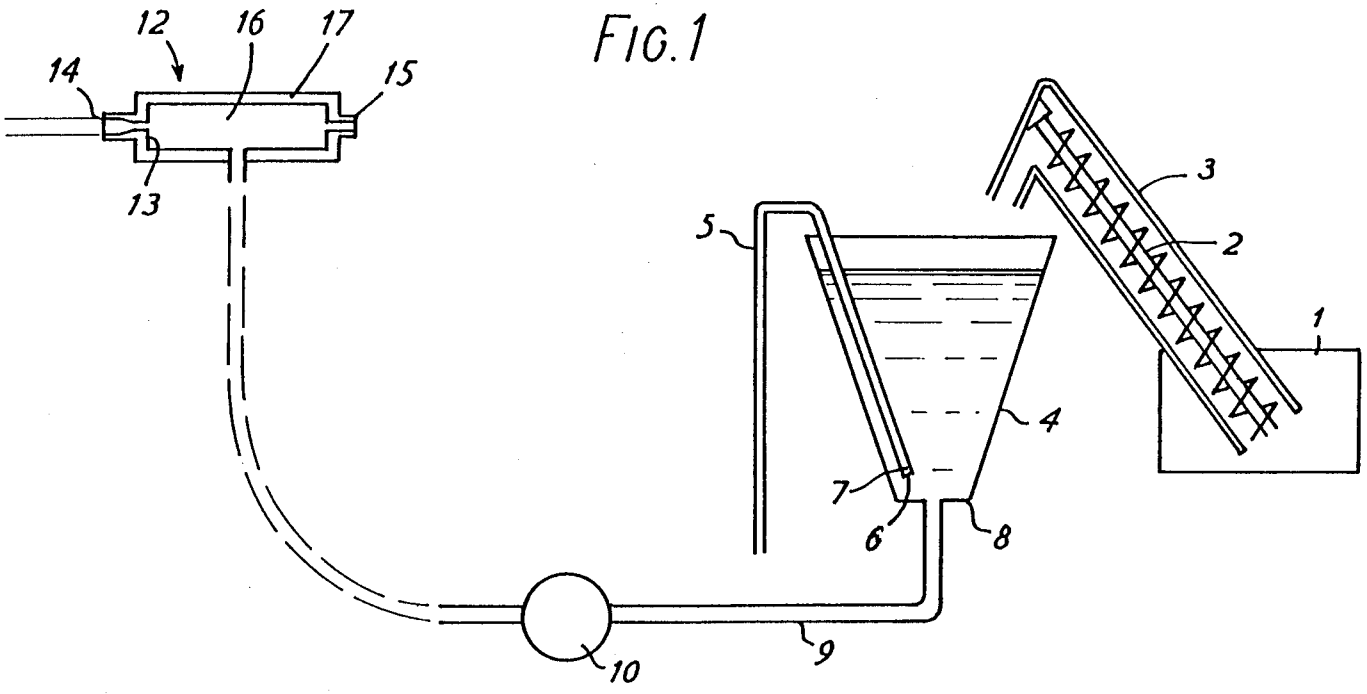
FIG. 1 is a schematic view of one form of apparatus according to the invention.

As shown in FIG. 1 apparatus according to the invention comprises a supply container for abrasive particles (1) from which a feed screw (2) operating within a tube (3) feeds the abrasive particles into a mixing hopper (4) in which they are mixed into a slurry with liquid. The mixing hopper (4) which is frustoconical in section is fed with liquid through a pipe (5) which runs closely down one side of the mixing hopper (4) and terminates at its lower end (6) in a plurality of radially extending outlets (7). The pipe (5) extends to a point close to the bottom (8) of the mixing hopper (4). The liquid is fed into the mixing hopper (4) under such pressure that it issues through the outlets (7) such as to cause a swirling and stirring motion throughout the whole height of the mixing hopper so as to create a substantially homogeneous slurry in the mixing hopper (4).

The slurry is pumped from the bottom (8) of the mixing hopper (4) through a pipe (9) by means of a pump (10).

At its outlet side the pump (10) pumps the slurry under pressure into the inlet (11) (FIG. 2) of the jetting head (12). The slurry enters the jetting head (12) tangentially in such a way that the centrifugal forces generated separate the abrasive particles from the liquid so that the abrasive particles concentrate against the upstream wall (13) of the jetting head (12). A fluid under high pressure is injected axially into the jetting head (12) through a jetting nozzle (14) and the abrasive particles are entrained in the outside portion of the fluid jet generated by the jetting nozzle (14) and carried to the outlet (15). The liquid that is separated from the slurry during introduction into the jetting head (12) is constrained to pass downstream of the jetting nozzle (14) and forms an annular layer surrounding the abrasive particles entrained in the outer portion of the jet.

Figure 2:
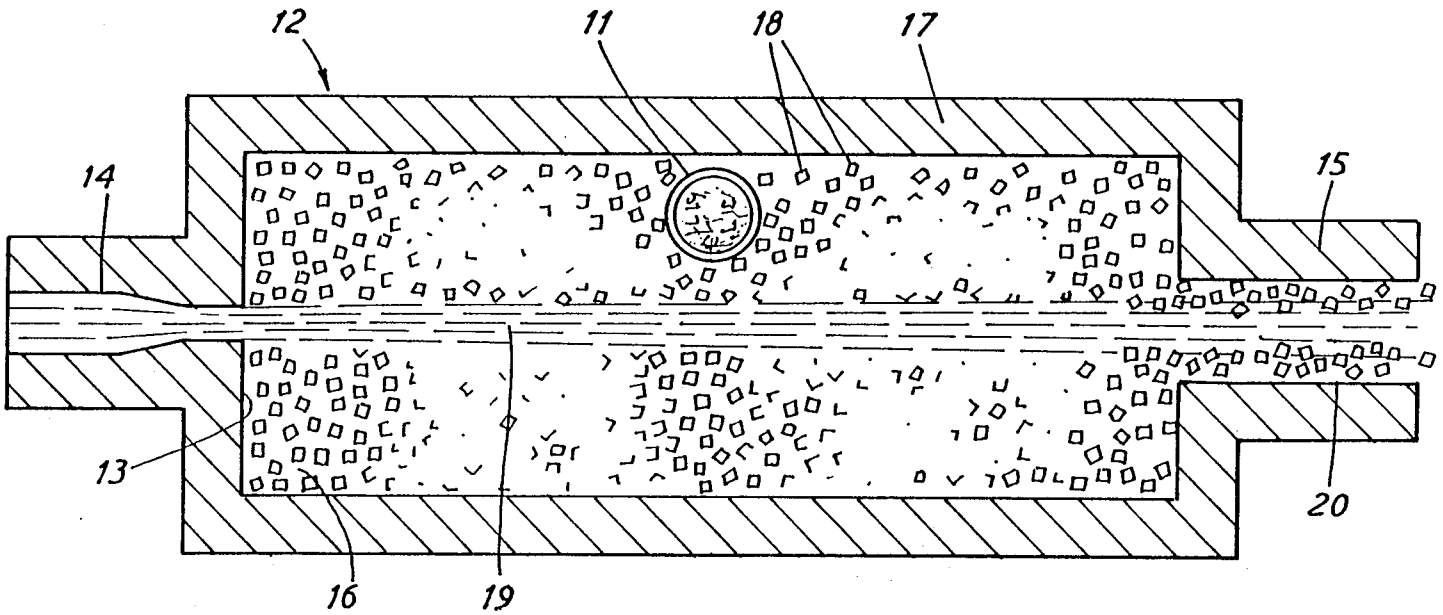
FIG. 2 is a schematic view of one form of jetting head for use in the apparatus according to the invention.

The jetting nozzle is shown in more detail in FIG. 2 of the drawings. The inlet means (11) extends tangentially into the transfer space (16) within a housing (17). The slurry is therefore directed into the transfer space (16) so as to flow along a spiral path. The centrifugal forces acting on the slurry cause separation of the abrasive particles (18) from the liquid and the abrasive particles move upstream of the jetting nozzle (14) until they are constrained by the rear wall (13) toward the housing to move inwardly until they contact and become entrained in the outer portion of the fluid jet (19) entering through jetting nozzle (14) and are carried by the fluid jet through the jetting head (12) to be ejected through the outlet (15).

The water from the slurry moves upstream of the jetting nozzle (14) and is ejected from the outlet (15) as a protective layer (20) surrounding the jet of abrasive particles (18) entrained in the fluid jet (19).

It will be appreciated that because the slurry is pumped into the jetting head (12), rather than drawn into the jetting head (12) by the venturi effect of the fluid jet (19) passing inlet (11), a high concentration of slurry and therefore of abrasive particles (18) can be introduced into the fluid jet (19). Moreover because the slurry is being positively pumped to the jetting head (12) it is possible to separate the jetting head (12) from the source of slurry by a long length of feed pipe (9) thus enabling the apparatus to be used in locations in which it is difficult or inconvenient to form the slurry for, for example, at high locations or under water.

I claim:

1. Apparatus for generating an abrasive fluid jet comprising feed means for continuously passing abrasive particles from an external supply at a constant rate to a mixing hopper, said mixing hopper having means for mixing the abrasive particles with a carrier liquid to produce a slurry of consistent concentration within the mixing hopper, pump means connected to an outlet of the mixing hopper for pumping the slurry from the mixing hopper to an inlet of a jetting head, means for introducing a stream of fluid into the jetting head as a high speed jet in a direction substantially axially of the jetting head whereby the abrasive particles pumped to said inlet are entrained in the fluid jet and ejected from the head at high speed to impinge upon an object to be abrasively treated.

2. Apparatus according to claim 1, wherein the jetting head comprises a housing defining a transfer space; outlet means defining an outlet aperture extending from the transfer space; jetting nozzle means of smaller cross section than the outlet means for directing a fluid as a jet axially into the transfer space and through the outlet aperture; inlet means located downstream from the jetting nozzle means along the axis of the jetting head for directing the pumped slurry of abrasive particles tangentially into the transfer space; the interior walls of the housing and the position of the inlet means being such that the slurry is conducted through the transfer space towards the jet and moves spirally upstream of the inlet means with a resulting centrifugal action that separates the abrasive particles from the carrier liquid of the slurry, the abrasive particles moving preferentially to the periphery of the transfer space and being constrained by a wall of the housing at the upstream end of the transfer space to move towards the axis of the jetting head to be entrained in the fluid jet issuing from the jetting nozzle and to pass through the outlet means while the carrier liquid from the slurry passes through the outlet means as an annular layer surrounding the fluid jet with the entrained abrasive particles.

3. Apparatus according to claim 1 wherein the feed means for the abrasive particles comprises an upwardly extending worm operating within a tube and having a significant radial clearance within the tube.

4. Apparatus according to claim 1 wherein the mixing hopper is a hopper of frustoconical section and the carrier liquid is fed into the bottom of the hopper with a swirling motion such as to thoroughly wet the abrasive particles and to maintain them in a suspension of constant concentration.

5. Apparatus according to claim 4, wherein the liquid feed to the mixing hopper comprises a pipe having a plurality of radiallyextending outlets at one end extending down one wall of the hopper to a point at or towards the bottom thereof so that the liquid issuing from the radial outlets causes a swirling motion in the bottom of the hopper which extends to the upper regions of the hopper thereby keeping the whole contents of the hopper in motion.

6. Apparatus according to claim 1 wherein the pump means comprises a positive displacement pump.

7. Apparatus according to claim 1, wherein the pump means comprises a centrifugal pump.

* * * * *